US005773409A

United States Patent [19]

Haq et al.

[11] Patent Number: 5,773,409

[45] **Date of Patent: *Jun. 30, 1998**

[54] FABRIC SOFTENING COMPOSITION

[75] Inventors: Ziya Haq, Wirral; Abid Nadim Khan-Lodhi, Chester; Philip John Sams, South Wirral, all of United Kingdom

[73] Assignee: Lever Brothers Company, Division of Conopco, Inc., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 729,517

[22] Filed: Oct. 10, 1996

Related U.S. Application Data

[63] Continuation of Ser. No. 417,565, Apr. 6, 1995, abandoned.

[30] Foreign Application Priority Data

| | | | |
|---|---|---|---|
| Apr. 7, 1994 | [GB] | United Kingdom | 9406827 |
| Apr. 7, 1994 | [GB] | United Kingdom | 9406831 |
| Apr. 7, 1994 | [GB] | United Kingdom | 9406832 |

[51] Int. Cl.[6] ..... D06M 13/46; D06M 13/00

[52] U.S. Cl. ..... 510/521; 510/515; 510/522; 510/526; 510/527

[58] Field of Search ..... 510/515, 521, 510/522, 526, 527

[56] References Cited

U.S. PATENT DOCUMENTS

| | | | |
|---|---|---|---|
| 3,892,669 | 7/1975 | Rapisarda et al. | 252/8.75 |
| 4,137,180 | 1/1979 | Naik | 252/8.8 |
| 4,238,531 | 12/1980 | Rudy et al. | 427/242 |
| 4,304,562 | 12/1981 | Bolan | 8/137 |
| 4,327,133 | 4/1982 | Rudy et al. | 427/242 |
| 4,769,159 | 9/1988 | Copeland | 252/8.8 |
| 4,789,491 | 12/1988 | Chang | 252/8.75 |
| 5,066,413 | 11/1991 | Kellett | 252/8.75 |
| 5,066,414 | 11/1991 | Chang | 252/8.8 |
| 5,093,014 | 3/1992 | Nellie | 252/8.8 |
| 5,154,838 | 10/1992 | Yamamura et al. | 252/8.6 |
| 5,259,964 | 11/1993 | Chavez et al. | 252/8.6 |
| 5,368,756 | 11/1994 | Vogel et al. | 252/8.8 |
| 5,399,272 | 3/1995 | Swartley et al. | 252/8.8 |
| 5,403,500 | 4/1995 | Turner | 252/8.8 |
| 5,407,589 | 4/1995 | Turner | 252/8.8 |
| 5,409,621 | 4/1995 | Ellis et al. | 252/8.8 |

FOREIGN PATENT DOCUMENTS

| | | |
|---|---|---|
| 1 005 204 | 2/1977 | Canada . |
| 569 847 | 11/1893 | European Pat. Off. . |
| 002 857 | 7/1979 | European Pat. Off. . |
| 013 780 | 8/1980 | European Pat. Off. . |
| 040 562 | 11/1981 | European Pat. Off. . |
| 054 493 | 6/1982 | European Pat. Off. . |
| 079 746 | 5/1983 | European Pat. Off. . |
| 111 074 | 6/1984 | European Pat. Off. . |
| 125 031 | 11/1984 | European Pat. Off. . |
| 157 618 | 10/1985 | European Pat. Off. . |
| 199 765 | 11/1986 | European Pat. Off. . |
| 238 638 | 9/1987 | European Pat. Off. . |
| 239 910 | 10/1987 | European Pat. Off. . |
| 280550 | 8/1988 | European Pat. Off. . |
| 293953 | 12/1988 | European Pat. Off. . |
| 309052 | 3/1989 | European Pat. Off. . |
| 326 213 | 8/1989 | European Pat. Off. . |
| 354 011 | 2/1990 | European Pat. Off. . |
| 361 593 | 4/1990 | European Pat. Off. . |
| 392 607 | 10/1990 | European Pat. Off. . |
| 404 471 | 12/1990 | European Pat. Off. . |
| 409504 | 1/1991 | European Pat. Off. . |
| 507 478 | 10/1992 | European Pat. Off. . |
| 532 488 | 3/1993 | European Pat. Off. . |
| 547 723 | 6/1993 | European Pat. Off. . |
| 568 297 | 11/1993 | European Pat. Off. . |
| 569 184 | 11/1993 | European Pat. Off. . |
| 1447334 | 6/1966 | France . |
| 2163771 | 3/1986 | United Kingdom . |
| 2173827 | 10/1986 | United Kingdom . |
| 2188653 | 10/1987 | United Kingdom . |
| 92/06161 | 4/1992 | WIPO . |
| 92/18593 | 10/1992 | WIPO . |
| 93/18125 | 9/1993 | WIPO . |
| 93/23510 | 11/1993 | WIPO . |
| 94/02676 | 2/1994 | WIPO . |
| 4643 | 3/1994 | WIPO . |
| 171169 | 8/1994 | WIPO . |
| 94/17169 | 8/1994 | WIPO . |
| 95/13346 | 5/1995 | WIPO . |

OTHER PUBLICATIONS

PCT Search Report dated Aug. 21, 1995.

PCT Search Report dated Jul. 6, 1995.

R. G. Laughlin, "Surfactant Science Series 2", vol. 37 (Cationic Surfactants Physical Properties, pp. 449–465, Marcel Decker, Inc. 1991.

D. Marsh, CRC Press, Boca Raton, Florida, 1990 no month available, "Handbook of Lipid Bilayers", pp. 137 and 337.

G.J.T. Tiddy et al., *J. Chem. Soc. Faraday Trans. 1.,* vol. 79, pp. 975, (1983) no month available.

*Primary Examiner*—Anthony Green

*Attorney, Agent, or Firm*—Matthew Boxer

[57] ABSTRACT

A fabric softening composition is described which has a substantially water-insoluble fabric softening compound and a solubilizing agent which is a non-ionic surfactant and may include a non-surfactant cosolubilizer. The composition is up to at least 70 wt. % soluble when diluted in water to a concentration of 5 wt. % of the mixture of the fabric softening compound and the solubilizing agent. The fabric softening compound comprises a head group and two alkyl or alkenyl chains each having an average chain link equal to a greater than $C_{14}$ or a single alkyl or alkenyl chain with an average chain link equal to a greater than $C_{20}$.

18 Claims, No Drawings

FABRIC SOFTENING COMPOSITION

This is a continuation application of Ser. No. 08/417,565, filed Apr. 6, 1995, now abandoned.

TECHNICAL FIELD

The present invention relates to fabric softening compositions. In particular the invention relates to fabric softening compositions that have excellent stability, dispensing and dispersing properties.

BACKGROUND AND PRIOR ART

Rinse added fabric softener compositions are well known. Typically such compositions contain a water insoluble fabric softening agent dispersed in water at a level of softening agent up to 7% by weight in which case the compositions are considered dilute, or at levels from 7% to 30% in which case the compositions are considered concentrates. Fabrics can also be softened by the use of sheets coated with softening compound for use in tumble dryers. In more detail the commercially available fabric softening compounds generally form stacked lamellar structures in water which have characteristic Lβ to Lα phase transition temperatures.

The rinse added fabric softening compositions of the prior art soften by depositing dispersed colloidal particles of softening compound onto fabrics, whilst dryer sheets soften fabrics by direct transfer of molten softening compound, as taught by the review by R. G. Laughlin in "Surfactant Science" Series 2 Volume 37 Cationic surfactants Physical Properties Pages 449 to 465. (Marcel Decker, inc, 1991)

Conventional liquid fabric softening compositions are in the form of dispersed colloidal particles of the fabric softening compound. Fabric softening compositions comprising dissolved fabric softening compound in organic solvent and as powder or granular compositions have also been described.

Fabric softening compositions formed from dispersed colloidal particles have complex, unstable structures. Because of this instability there are many problems associated with conventional fabric softening compositions. The principal problems are: physical instability at high and low temperatures; when frozen they are converted irreversibly to gels; it is difficult to obtain compositions that exhibit good dispersibility into the wash liquor, deposition onto the fabrics and dispensability from the washing machine dispenser drawer. Poor dispersibility results in uneven coating of fabric softener onto the laundry and in some cases spotting can occur. These problems are exacerbated in concentrated fabric softening compositions and on the addition of perfume.

Physical instability manifests itself as a thickening on storage of the composition to a level where the composition is no longer pourable, and can even lead to the irreversible formation of a gel. The formation of a gel can also occur in the dispensing drawer of a washing machine when the temperature of the drawer is increased by the influx of warm water. The thickening is very undesirable since the composition can no longer be conveniently used. Physical instability can also manifest itself as phase separation into two or more separate layers.

Concentrated products, good dispersibility and dispensability, and storage stability at low or high temperature are however desired by the consumer.

The problems associated with conventional dispersed colloidal particles are addressed by the prior art.

U.S. Pat. No. 4,789,491 (Chang) discloses a specific process for the formulation of aqueous dispersions of cationic softening compounds. The process is said to overcome the difficulties of product viscosity and poor dispensing and dispersing on storage.

EP 0 239 910 (Procter and Gamble)) discloses compositions containing dispersions of either diester or monoester quaternary ammonium compounds in which the nitrogen has either two or three methyl groups, stabilized by maintaining a critical low pH.

The physical stability of rinse added fabric softener compositions has been improved by the addition of viscosity control agents or anti-gelling agents. For example in EP 13 780 (Procter and Gamble) viscosity control agents are added to certain concentrated compositions. The agents may include $C_{10}$–$C_{18}$ fatty alcohols. More recently in EP 280 550 (Unilever) it has been proposed to improve the physical stability of dilute compositions comprising biodegradable, quaternary ammonium compounds and fatty acid by the addition of nonionic surfactants. EP 507 478 (Unilever) discloses a physically stable fabric softening composition comprising a water insoluble, biodegradable, ester-linked quaternary ammonium compounds and a nonionic stabilising agent.

Various proposals have been made to supply fabric softener in granular or powdered form. EP 111074 is typical and uses a silica to carry the softener. A disadvantage of using a carrier such as silica is that it bulks up the product and serves no function beyond making the powder compatible with other ingredients that may be contained in a washing powder.

EP 569 184 (Unilever) discloses use of a granular composition to form a pre-dilute which is then added to the dispenser drawer of the washing machine.

WO 92/18593 (Procter and Gamble) discloses a granular fabric softening composition which can be added to water to form an aqueous emulsion. The composition contains a nonionic fabric softener such as a sorbitan ester and a mono-long chain alkyl cationic surfactant.

WO 93/23510 (Procter and Gamble) discloses liquid and solid fabric softeners comprising biodegradable diester quaternary ammonium fabric softening compounds and a viscosity and/or dispersibility modifier, the application also discloses specific processes for making these products. The viscosity and/or dispersibility modifier may be a single long chain, alkyl cationic or a nonionic surfactant. The solid composition when added to water forms an emulsion or dispersion.

Our co-pending application GB 9323263.4 discloses the use of a tegobetaine to overcome the problem of instability induced by perfume in concentrated fabric softeners.

In an attempt to overcome the problems associated with dispersed colloidal particles, the prior art has turned to fabric conditioners in the form of solutions of fabric softening compounds in organic solvents. Systems of this type are exemplified by our co-pending application GB 9301811.7. However on contact with water dispersed colloidal particles are still formed.

A further way of making solutions of fabric conditioners is by specific structural modifications.

U.S. Pat. No. 3,892,669 (Lever Brothers) discloses a clear, homogeneous, aqueous based liquid fabric softening composition and is limited to solubilised tetraalkyl quaternary ammonium salts having two short-chain alkyl groups and two long-chain alkyl groups, the longer chain groups having some methyl and ethyl branching. The solubilisers comprise of aryl sulphonates, diols, ethers, low molecular weight quaternaries, sulphobetaines, and nonionic surfactants. The specification teaches that nonionic surfactants and phosphine oxides are not suitable for use alone and only have utility as auxiliary solubilisers.

We have surprisingly found that a novel fabric softening composition can be formed without the disadvantages of the prior art. The present invention provides fabric softening compositions having excellent softening properties yet which exhibit excellent storage stability at both high and low temperatures, good freeze thaw recovery and excellent dispensability and dispersibility when the fabric softening compound is concentrated and even when the compound is concentrated to levels greater than 30 wt %. Furthermore, compositions prepared according to our invention do not suffer from loss of softening performance.

DEFINITION OF THE INVENTION

Thus according to one aspect of the invention there is provided a fabric softening composition comprising i) a substantially water insoluble fabric softening compound comprising a head group and two linear alkyl or alkenyl chains each having an average chain length equal to or greater than $C_{14}$ or a single alkyl or alkenyl chain with an average chain length equal to or greater than $C_{20}$ and;

ii) a solubilising agent comprising a nonionic surfactant and optionally a non-surfactant cosolubiliser;

characterised in that when the fabric softening composition is diluted in water to a concentration 5 wt % of (i)+(ii), at least 70wt % of the fabric softening compound is in solution.

A further aspect of the invention provides the use of self-size-limiting molecular aggregates (as defined below) as a fabric softening composition.

DETAILED DESCRIPTION OF THE INVENTION

Without wishing to be bound by theory it is believed that the fabric conditioner of the invention is not in conventional lamellar form, and when contacted with water may be solubilised partially in the form of self-size-limiting molecular aggregates, such as micelles or micellar structures with solid or liquid interiors or mixtures thereof. Where the composition is in a form containing water the composition itself may be at least partially in the form of self-size-limiting molecular aggregates. It is thought that it is this new structure of the fabric softening compositions that overcomes the problems of the prior art.

Suitably the fabric softening compound and solubilising agent form a transparent mix. However, the following tests may be used to determine definitely whether or not a composition falls within the present invention.

Test I a) The fabric softening composition is diluted with water at a concentration of 5 wt % (of the fabric softening compound and the total solubilising agent, i.e. the nonionic surfactant and any non-surfactant cosolubiliser). The dilute is warmed to between 60°–80° C. then cooled to room temperature and stirred for 1 hour to ensure equilibration. A first portion of the resulting test liquor is taken and any material which is not soluble in the aqueous phase is separated by sedimentation or filtration until a clear aqueous layer is obtained. (Ultaracentrifuges or ultrafilters can be used for this task.) The filtration may be performed by passing through successive membrane filters of 1 μm, 0.45 μm and 0.2 μm.

b) The concentration of the fabric softening compound in the clear layer is measured by titrating with standard anionic surfactant (sodium dodecyl sulphate) using dimidiumsulphide disulphine blue indicator in a two-phase titration with chloroform as extracting solvent.

c) The titration with anionic surfactant is repeated with a second portion of fabric softening composition which has been diluted but not separated.

d) Comparison of b) with c) should show that the concentration of fabric softening compound in b) is at least 70 wt % (preferably 80 wt %) of the concentration of fabric softening compound in c). This demonstrates that the fabric softening compound was in solution.

The Test I procedure is suitable for compositions in which the fabric conditioner is cationic (or becomes cationic on dilution). The following tests are also suitable for non-cationic compositions.

Test II a) The fabric softening composition is diluted as for Test I.

b) The viscosity of the diluate at a shear rate of 110s−1 is measured.

c) The diluate is warmed to 60° C. and held at this temperature for 1 day.

d) The diluate with gentle stirring is cooled to 20° C. and the viscosity is once again measured at a shear rate of 110s−1.

e) Comparison between the viscosities of b) and c) should show that they differ by less than 5 mPas.

It is preferable if the fabric softening composition of the invention conforms to the following test:

Test III a) The fabric softening composition is diluted as for test I.

b) The viscosity of the diluate at a shear rate of 110s−1 is measured.

c) The diluate is frozen and thawed.

d) The viscosity is once again measured at a shear rate of 110s−1.

e) Comparison between the viscosities of b) and c) should show that they differ by less than 10 mPaS.

The fabric softening compositions according to the invention may be translucent. Translucent in the context of this invention means that when a cell 1 cm in depth is filled with the fabric softening composition, "Courier 12 point" typeface can be read through the cell.

A further advantage of the present invention is that the softening of the composition is enhanced over compositions of the prior art comprising similar levels of fabric softening compound.

The present invention has the advantage that high levels of perfume can be tolerated without adversely effecting the stability of the product.

The Fabric Softening Compound

The fabric softening compound is either a substantially water insoluble quaternary ammonium material comprising a single alkyl or alkenyl chain having an average length equal to or greater than $C_{20}$ or more preferably a compound comprising a polar head group and two alkyl or alkenyl chains each having an average chain length equal to or greater than $C_{14}$.

Preferably the fabric softening compound of the invention has two long alkyl or alkenyl chains with an average chain length equal to or greater than $C_{14}$. More preferably each chain has an average chain length greater than $C_{16}$. Most preferably at least 50% of each long chain alkyl or alkenyl group has a chain length of $C_{18}$.

It is preferred if the long chain alkyl or alkenyl groups of the fabric softening compound are predominantly linear.

The fabric softening compounds used in the compositions of the invention are molecules which provide excellent softening, and are characterised by a chain melting –Lβ to Lα—transition temperature greater than 25° C., preferably greater than 35° C., most preferably greater than 45° C. This Lβ to Lα transition can be measured by DSC as defined in "Handbook of Lipid Bilayers, D Marsh, CRC Press, Boca Raton Fla., 1990 (Pages 137 and 337).

Substantially insoluble fabric softening compounds in the context of this invention are defined as fabric softening compounds having a solubility less than $1\times10^{-3}$ wt % in demineralised water at 20° C. Preferably the fabric softening compounds have a solubility less than $1\times10^{-4}$. Most preferably the fabric softening compounds have a solubility at 20° C. in demineralised water from $1\times10^{-8}$ to $1\times10^{-6}$.

Preferred fabric softening compounds are quaternary ammonium compounds.

It is especially preferred if the fabric softening compound is a water insoluble quaternary ammonium material which comprises a compound having two $C_{12-18}$ alkyl or alkenyl groups connected to the molecule via at least one ester link. It is more preferred if the quaternary ammonium material has two ester links present. An especially preferred ester-linked quaternary ammonium material for use in the invention can be represented by the formula:

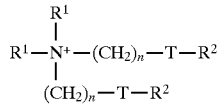

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups;

T is

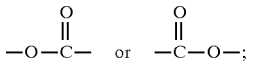

and n is an integer from 0–5.

Di(tallowyloxyethyl) dimethyl ammonium chloride is especially preferred.

A second preferred type of quaternary ammonium material can be represented by the formula:

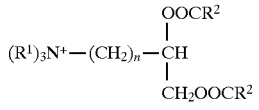

wherein $R^1$, n and $R^2$ are as defined above.

It is advantageous for environmental reasons if the quaternary ammonium material is biologically degradable.

Preferred materials of this class such as 1,2 bis[hardened tallowoyloxy]-3-trimethylammonium propane chloride and their method of preparation are, for example, described in U.S. Pat. No. 4,137,180 (Lever Brothers). Preferably these materials comprise small amounts of the corresponding monoester as described in U.S. Pat. No. 4,137,180 for example 1-hardened tallowoyloxy-2-hydroxy 3-trimethylammonium propane chloride.

Lecithins are also suitable softening compounds.

The Nonionic Solubiliser

The solubilising agent is a nonionic surfactant, and is characterised in terms of its phase behaviour. Suitable solubilising agents are nonionic surfactants for which when contacted with water, the first lyotropic liquid crystalline phase formed is normal cubic (I1) or normal cubic-bicontinuous (V1) or hexagonal (H1) or nematic (Ne1), or intermediate (Int1) phase as defined in the article by G J T Tiddy et al, J Chem Soc. Faraday Trans. 1., 79, 975, 1983 and G J T Tiddy , "Modern Trends of Colloid Science in Chemistry and Biology", Ed. H-F Eicke, 1985 Birkhauser Verlag Basel. Surfactants forming Lα phases at concentrations of less than 20 wt % are not suitable.

For the purposes of this invention nonionic surfactants may be defined as substances with molecular structures consisting of a hydrophilic and hydrophobic part. The hydrophobic part consists of a hydrocarbon and the hydrophilic part of strongly polar groups. The nonionic surfactants of this invention are soluble in water.

The most preferred nonionic surfactants are alkoxylated, preferably ethoxylated compounds and carbohydrate compounds. Where the composition is in solid form, for example a powder, the nonionic surfactant is desirably a carbohydrate compound or derived from a carbohydrate compound.

Examples of suitable ethoxylated surfactants include ethoxylated alcohols, ethoxylated alkyl phenols, ethoxylated fatty amides and ethoxylated fatty esters.

Preferred nonionic ethoxylated surfactants have an HLB of from about 10 to about 20. It is advantageous if the surfactant alkyl group contains at least 12 carbon atoms.

Examples of suitable carbohydrate surfactants or other polyhydroxy surfactants include alkyl polyglycosides as disclosed in EP 199 765 (Henkel) and EP 238 638 (Henkel), poly hydroxy amides as disclosed in WO 93 18125 (Procter and Gamble) and WO 92/06161 (Procter and Gamble), fatty acid sugar esters (sucrose esters), sorbitan ester ethoxylates, and poly glycerol esters and alkyl lactobionamides.

Excellent softening is achieved if mixtures of carbohydrate based nonionic surfactants and long chain ethoxylate based nonionic surfactants are used. Preferably the ratio of carbohydrate compounds to long chain alcohol ethoxylate is from 3:1 to 1:3, more preferably from 1:2 to 2:1, most preferably approximately at a ratio of 1:1.

Mixtures of solubilising agents may be used.

For compositions in solid form, especially powder, the solubilising is desirably solid at room temperature as this provides crisp composition particles. It is particularly advantageous if the solubilising agent further comprises a non-surfactant co-solubiliser. Preferred co-solubilisers include propylene glycol, urea , acid amides up to and including chain lengths of $C_6$, citric acid and other poly carboxylic acids as disclosed in EP 0 404 471 (Unilever), glycerol, sorbitol and sucrose. Particularly preferred are polyethylene glycols (PEG) having a molecular weight ranging from 200–6000, most preferably from 1000 to 2000.

It is advantageous if the weight ratio of solubilising agent (where relevant this would also include the co-solubiliser) to fabric softening compound is greater than 1:6, preferably greater than 1:4, more preferably equal to or greater than 2:3.

It is advantageous if the ratio of solubilising agent to fabric softening compound is equal to or below 4:1, more preferably below 3:2.

It is preferred if the ratio of co-solubiliser to nonionic surfactant is from to 2:1 to 1:40, preferably the ratio of co-solubiliser to nonionic surfactant is less than 1:1, more preferably less than 1:5.

It is beneficial if the solubilising agent/co-solubiliser is present at a level greater than 5 wt % of the total composition, preferably at a level greater than 10 wt %.

Where the composition is a solid, the solubilising agent is preferably present at a level of greater than 20% and more preferably greater than 30% by weight of the composition.

Composition pH

The compositions of the invention preferably have a pH of more than 1.5, more preferably less than 5.

Other Ingredients

The composition can also contain fatty acids, for example $C_8$–$C_{24}$ alkyl or alkenyl monocarboxylic acids, or polymeric carboxylic acids. Preferably saturated fatty acids are used, in particular, hardened tallow $C_{16}$–$C_{18}$ fatty acids.

The level of fatty acid material is preferably more than 0.1% by weight, more preferably more than 0.2% by weight. Especially preferred are concentrates comprising from 0.5 to 20% by weight of fatty acid, more preferably 1% to 10% by weight. The weight ratio of fabric softening compound to fatty acid material is preferably from 10:1 to 1:10.

Compositions according to the present invention may contain detergency builders and/or anionic surfactants as desired. However it is especially preferred that the composition is substantially free of builders. It is also preferred that the composition be substantially free of anionic surfactant.

Suitably the composition is substantially free of nonionic hydrophobic organic materials such as hydrocarbons and hydrocarbyl esters of fatty acids.

The composition can also contain one or more optional ingredients, selected from non-aqueous solvents, pH buffering agents, perfumes, perfume carriers, fluorescers, colorants, hydrotropes, antifoaming agents, antiredeposition agents, polymeric and other thickeners, enzymes, optical brightening agents, opacifiers, anti-shrinking agents, anti-wrinkle agents, anti-spotting agents, germicides, fungicides, anti-oxidants, anti-corrosion agents, drape imparting agents, antistatic agents and ironing aids.

Product Form

The product may be in any product form. Particularly preferred forms are liquid and solid compositions, and compositions suitable for coating onto a dryer sheet. Solid composition in this context are suitably in the form of a tablet, a gel, a paste and preferably granules or a powder.

The composition may be used in a tumble drier but is preferred for use in a washing machine for example by dispensing the composition via a drawer optionally with dilution prior to dosing into the dispensing drawer.

Preparation of the Composition

The invention further provides a process for preparing a fabric softening composition, as described above, which comprises the steps of:

i) mixing the substantially water insoluble fabric softening compound and the solubilising agent, preferably by co-melting; and ii) adding the resulting mixture to conventional ingredients for example, water.

Alternatively the composition may be prepared by the independent addition of the water insoluble fabric softening compound and the solubilising agent to conventional ingredients.

Compositions in solid form may be prepared by spray drying, freeze drying, milling, extraction, cryogenic grinding or any other suitable means.

The invention will now be illustrated by the following non-limiting examples. In the examples all percentages are expressed by weight.

Comparative Examples are designated by letters, while Examples of the invention are designated by numbers.

Preparation of Examples

The following examples were prepared by one of the following methods:

1) co-melting the fabric softening compound in the solubilising agent and adding the resulting dispersion in the required amount of hot water.

2) Sequentially adding the fabric softening compound and the solubilising agent to hot water.

In the comparative examples where there is no solubilising agent present the fabric softening compound was dispersed in hot water (liquid compositions).

In the Examples:

HT TMAPC=1,2 bis[hardened tallowoyloxy]-3 trimethylammonium propane chloride (ex Hoechst)

DEQA=di(tallowyloxyethyl) dimethyl ammonium chloride (ex Hoechst)

Softness Evaluation

Softening performance was evaluated by adding 0.1 g of fabric softening compound (2 ml of a 5% a.d. dispersion for liquids) to 1 liter of tap water, 10° F., at ambient temperature containing 0.001% (w/w) sodium alkyl benzene sulphonate (ABS) in a tergotometer. The ABS was added to simulate carryover of anionic detergent from the main wash. Three pieces of terry towelling (8 cm×8 cm, 40 g total weight) were added to the tergotometer pot. The cloths were treated for 5 minutes at 65 rpm, spin dried to remove excess liquor and line dried overnight.

Softening of the fabrics was assessed by an expert panel of 4 people using a round robin paired comparison test protocol. Each panel member assessed four sets of test cloths. Each set of test cloths contained one cloth of each test system under a evaluation. Panel members were asked to assess softness on a 8 point scale. Softness scores were calculated using an "Analysis of Variance" technique. Lower values are indicative of better softening.

EXAMPLES 1 to 4 and A to B

The Examples (Series a) and b)) were prepared according to either of the standard methods described above for the Preparation of the Examples. Series C) were prepared by mixing the components with water at 70° C. and freeze drying. Ratios of softening compound to solubilising agent were adjusted. Softening performance was measured; the level of compound and solubilising agent combined was 0.1 g/liter of water. The procedure was repeated for 3 solubilising agents.

TABLE 1

| Example | HTTMAPC: Solubilising agent* | Softness Score a) | b) | c) |
|---|---|---|---|---|
| A | 5:0 | 3.5 | 3.2 | 2.75 |
| B | 0:5 | 7.0 | — | — |
| 1 | 4:1 | 3.0 | 3.5 | 2.75 |
| 2 | 3:2 | 3.75 | 3.0 | 3.0 |
| 3 | 2:3 | 4.0 | 3.75 | 4.2 |
| 4 | 1:4 | 6.8 | 4.75 | 4.5 |

a) Tween 20 (ex ICI) = Polyoxyethylene sorbitan monolaurate
b) MARLIPALO 13/50 (ex Huls) = $C_{13}$ 15EO
c) N-Cocolactobionamide Compositions in Series C) were subjected to the Solubility Test described below in Examples 5 to 9 and to Test II and III described above.

| Series C) | % Cationic remaining 1 μm | % Cationic remaining 0.2 μm | Initial Viscosity/ mPas | TEST II Viscosity after 24 hours 60° C./ mPas | TEST III Viscosity after Freeze-thaw/ mPas |
|---|---|---|---|---|---|
| A | 10 | — | | | |
| 1 | | 91 | 2.6 | 2.4 | 2.1 |
| 2 | | 85 | 2.1 | 2.0 | 1.7 |
| 3 | | 100 | 2.3 | 3.4 | 1.8 |
| 4 | | 100 | 2.5 | 1.4 | 3.1 |

EXAMPLES 5 to 9 and C to F

Examples were made up according to either of the standard methods described above for Preparation of the Examples.

The formulations are listed below in Table 2:

TABLE 2

Liquid Compositions

| Composition | C | D | E | F | 5 | 6 | 7 | 8 | 9 |
|---|---|---|---|---|---|---|---|---|---|
| | Example | | | | | | | | |
| | wt. % | | | | | | | | |
| HT TAMPC | 4.6 | 12 | — | 14.5 | 8.59 | 8.59 | 8.59 | 8.59 | 8.59 |
| DEQA | | — | 22.6 | — | — | — | — | — | — |
| Fatty Acid | 0.77 | 2 | 1.7 | 2.42 | 0.41 | 0.41 | 0.41 | 2.42 | 0.41 |
| Genapol T-150 | 0.1 | 1.5 | — | — | — | — | — | — | — |
| Genapol C-100 | — | — | — | — | — | — | — | 6 | — |
| Genapol C-150 | — | — | — | — | — | — | — | — | 6 |
| Genapol C-200 | — | — | — | 1.0 | — | — | — | — | — |
| Tween 60 | — | — | — | — | — | — | 6 | — | — |
| Tween 20 | — | — | — | — | 6 | 6 | — | — | — |
| PEG 1500 | — | — | 1.5 | — | — | — | — | — | — |
| NaCl | — | — | 1.1 | — | — | — | — | — | — |
| Perfume | 0.5 | 0.9 | — | 1 | 1.5 | 1.5 | 1 | 1 | 1 |
| Water | | | | | to 100 | | | | |
| Silicone | 0.05 | 0.06 | 0.06 | 0.06 | 0.06 | 0.06 | 0.06 | 0.06 | 0.06 |

Fatty acid = Pristerine 4916 ex Unichema
PEG 1500 = Polyethylene glycol (mwt 1500) ex BDH
Genapol T-150 = (Tallow 15EO) ex Hoechst
Genapol C-100 = (Coco 10EO) ex Hoechst
Genapol C-150 = (Coco 15EO) ex Hoechst
Tween 60 = Polyoxyethylene (20) sorbitan mono stearate) ex ICI
Tween 20 = Polyoxyethylene (20) sorbitan mono laurate) ex ICI
Genapol C-200 = Coco 20EO ex Hoechst.

Solution Test

Examples C, D and E, all commercially available products, and Examples 5, 8 and 9 were consecutively passed through membrane filters of different pore size (1 μm, 0.45 μm and 0.2 μm) to achieve separation and the cationic material remaining was monitored by standard titration as described in Test 1 above.

TABLE 3

| | % Cationic remaining 0.45 μm | % Cationic remaining 0.2 μm |
|---|---|---|
| C | 12.8 | |
| D | | 5.5 |
| E | | 18 |
| 5 | | 95 |
| 8 | | 100 |
| 9 | | 90 |

Dispensing

The residue in a washing machine dispenser was measured by adding 10 mls of demin. water to a clean, dry dispenser followed by addition of the conditioner composition. The machine was then run on a cotton main wash cycle at 95° C. At the end of the wash a visual assessment was made of the residue and level of residue, the results are shown in table 4.

TABLE 4

| Example | Dose (g) | Residue Visible | Level of Residue |
|---|---|---|---|
| 5 | 37.5 | No | — |
| 6 | 37.5 | No | — |
| C | 37.5 | Yes | 5% |
| E | 24.15 | Yes | 7% |
| F | 38.79 | Yes | 30% |

Residue

The residue on cloth was measured by pouring the composition of the Examples into a pre-weighed black cloth (205×205 mm) approximately folded to form a pocket and thus entrap the composition, to ensure that the composition can only diffuse through the fabric. The entire cloth was submerged in a 1000 ml beaker containing 1000 mls of demin. water. The cloth was kept submerged for 2 minutes under static conditions. After 2 mins the cloth was removed and held on top of the beaker and allowed to drain under gravity for 1 min.

The cloth was then opened and examined for residues. The wet cloth was then placed on pre-weighed piece of paper and dried in an oven at 80° C. for 2 days. The residue was calculated by re-weighing the cloth+paper and from a knowledge of the solid contents of the liquids.

The results are shown in table 5.

TABLE 5

| Example | Dose/g | Residue Visible | Level of Residue* |
|---|---|---|---|
| D | 15.66 | Yes | 40% |
| D | 8.8 | Yes | 43% |
| E | 9 | Yes | 32% |
| E | 14 | Yes | 26% |
| 7 | 14 | No | not detectable |
| F | 14.5 | Yes | 68% |

*Level of residue = (weight of solid remaining/weight of solids in added liquid) × 100.

Dispersibility

The residual film removal method provides a means of testing liquid dispersibility by studying the removal of residual films formed by rinse conditioner liquids on the inside wall of a glass tube (7×6 mm) as a function of rates of water flow through the tube.

The residual film removed was measured by injecting 0.2 ml of liquid into a glass tube which was then clamped vertically over a beaker and left to stand for 10 seconds. Water was then pumped through the glass tube containing the sample using a non-pulsating pump. The time for films to be removed from the inside the tube surface was recorded by visual observation. Each experiment was repeated in triplicate for each flow rate. Water soluble dyes were dissolved in the liquids to aid the detection of films.

TABLE 6

| | Time Required for Film Removal at Various Flow Rates/sec. | | |
|---|---|---|---|
| Example | 400 ml/min | 600 ml/min | 800 ml.min |
| D | 20 | 8 | 4.67 |
| E | 15.33 | 9.67 | 7 |
| 5 | Instant | Instant | Instant |
| 6 | Instant | Instant | Instant |
| F | 49.33 | 20 | 3.33 |

Freeze Thaw Stability

The freeze-thaw stability of the examples was measured by placing 50 ml of the examples in a freezer until frozen. Frozen samples were then allowed to thaw. Initial (prior to freezing) viscosity and viscosities after being allowed to thaw for 24 hrs are shown below in Table 7. The examples of the invention are more robust to freeze-thaw than the comparative examples.

TABLE 7

| Example | Initial Viscosity/ mPaS | Freeze-thawed Viscosity/mPaS |
|---|---|---|
| C | 45 | Gelled |
| ⅓ dilution of C | 3.5 | 13.4 |
| E | 48 | Gelled |
| ⅓ dilution of E | 42.1 | Gelled |
| 5 | 4.0 | 7.8 |
| 6 | 4.6 | 5.7 |
| 8 | 4.7 | 3.1 |
| 9 | 3.43 | 5.3 |
| F | 36 | Gelled |

High Temperature Stability

High Temperature stability was measured by placing the compositions in the oven at 60° C. for 60 hours. Initial and final viscosities are shown below.

TABLE 9

| Sample | Initial Viscosity/ mPas | After 60 hrs/ mPas |
|---|---|---|
| C | 45 | Gelled |
| E | 46 | Gelled |
| 7 | 3.9 | 3.3 |
| F | 36 | Gelled |

The examples of the invention exhibit superior dispersing and dispensing properties than the comparative examples.

EXAMPLES 10 to 12a and G

The following compositions were prepared by melting the ingredients together, allowing to cool and transferring to a high shear cutting vessel and ground to a powder.

| | G | 10 | 11 | 12 | 12a |
|---|---|---|---|---|---|
| HEQ | 66.6 | 64.0 | 56.0 | 48.0 | 4.8 |
| fatty acid (ex-active) | 4.9 | — | — | — | — |
| Dobanol 91-6 ($C_{9-11}$ 6EO) | 0.5 | — | — | — | — |
| PEG 1500 | 2.6 | — | — | — | — |
| NaCl | 8.5 | — | — | — | — |
| Propylene glycol | 6.56 | — | — | | — |

-continued

| | G | 10 | 11 | 12 | 12a |
|---|---|---|---|---|---|
| Plantaren 2000 | — | 16.0 | — | 28.0 | — |
| N-Methyl-1 deoxyglucityl lauramide | — | — | 8.0 | — | — |
| Coco 10EO | — | — | 16.0 | 8.0 | — |
| Cocolacto bionamide | — | — | — | — | 3.2 |
| Softline 2000 (perfume) | 3.50 | 4.75 | 4.75 | 4.75 | 4.75 |
| Microsil silica | 13 | 5 | 5 | 5 | 5 |

Fatty acid = Pristerine 4916 ex Unichema
Coco 10EO = (Genapol C-100) ex Hoechst
Planteren 2000 = $C_{8-14}$ DP1.4 alkyl polyglucoside ex Henkel
Dobanol (ex Shell)
Microsil (ex Crosfields)

50 g (12 20×20 cm pieces) of black polycotton, were rinsed in tergotometer 50 rpm) containing 500 ml of water and 0.01% ABS (alkyl benxene sulphonate) for 5 minutes. 0.3 g of rinse conditioner powder was sprinkled on to the clothes while they were still in the pot and mixed carefully. The clothes were then rinsed for another five minutes and removed from the solution. The clothes were then spin dried for 30 seconds and then line dried carefully to avoid residue from dislodging.

The cloth are then assessed for residues according to the following criteria:

Frequency: ie the number of cloths with residue

% Area: ie Percentage of cloth area covered with residue

Patches: ie patch of residue given a score of 1 to 5 depending on intensity.

Summary of test results are given below:

| Example | % Average Area | Frequency | Patches |
|---|---|---|---|
| G | 20 | 12/12 | 2 |
| 10 | 0.67 | 4/12 | <1 |
| 11 | 1.75 | 9/12 | <1 |
| 12 | 0.42 | 1/12 | <1 |

The softening effect of the compositions were measured and they were subjected to the Solubility Test described in Examples 5 to 9.

| Example | Softness Score | % Cationic remaining 0.2 μm |
|---|---|---|
| G | 4.85 | 10 |
| 10 | 3.75 | 90 |
| 11 | 3.5 | 85 |
| 12 | 2.75 | 83 |
| 12a | 3.75 | 86 |

Examples 13 to 23

Compositions were prepared according to either of the standard methods described above for preparation of the Examples. The formulations are listed below.

| | 13 | 14 | 15 | 16 | 17 | 18 | 19 | 20 | 21 | 22 | 23 |
|---|---|---|---|---|---|---|---|---|---|---|---|
| HTMAPC | 8.7 | 8.7 | 8.7 | 8.7 | 8.7 | 8.7 | 8.7 | 8.7 | 8.7 | 8.7 | 8.7 |
| Fatty acid | 0.3 | 0.3 | 0.3 | 0.3 | 0.3 | 0.3 | 0.3 | 0.3 | 0.3 | 0.3 | 0.3 |
| Coco 10EO | 6 | | | | | | | | | | |
| Coco 15EO | | 6 | | 6 | 6 | 6 | 6 | 6 | 6 | 6 | 6 |
| Tween 20 | | | 6 | | | | | | | | |
| Glycerol | | | | 2.5 | 7.5 | | | | | | |
| Urea | | | | | | 0.5 | 1.5 | 3 | | | |
| Citric acid | | | | | | | | | 0.25 | 0.5 | 2 |
| Propylene glycol | 0.67 | 0.67 | 0.67 | 0.67 | 0.67 | 0.67 | 0.67 | 0.67 | 0.67 | 0.67 | 0.67 |
| Perfume | 0.9 | 0.9 | 0.9 | 0.9 | 0.9 | 0.9 | 0.9 | 0.9 | 0.9 | 0.9 | 0.9 |
| To 100% | with water | | | | | | | | | | |

Storage Stability

The viscosities of the composition were measured on a Carri-med CSL 100 rheometer at a shear rate of 110 $s^{-1}$. The results are shown below.

| | 13 | 14 | 15 | 16 | 17 | 18 | 19 | 20 | 21 | 22 | 23 |
|---|---|---|---|---|---|---|---|---|---|---|---|
| Viscosity (25° C.) Initial/mPas | 10 | 7 | 9 | 7 | 9 | 8 | 7.3 | 4.8 | 5.8 | 6.6 | 5.6 |
| 37° C. 4 weeks | 11.5 | 7.8 | 14.6 | 8.2 | 18.6 | 8 | 7.8 | 5.8 | 8.5 | 6.4 | 6.9 |
| 37° C. 8 weeks | 13.5 | 14.9 | 19.3 | 15.9 | 20.3 | 11.5 | 9.9 | 6.9 | 11.1 | 10.2 | 9 |
| 37° C. 12 weeks | 10 | 12.1 | 22.5 | 11.2 | 20 | 16.8 | 14.1 | 7.1 | 10.8 | 10.9 | 7.7 |
| 22° C. 4 weeks | 9.9 | 6.2 | 14.3 | 5.2 | 7.1 | 5.8 | 6.6 | 4.3 | 4.7 | 5.3 | 5.6 |
| 22° C. 8 weeks | 12.1 | 7.9 | 15.2 | 7.2 | 10.1 | 6.3 | 7.1 | 4.9 | 6.4 | 6.1 | 7.2 |
| 22° C. 12 weeks | 10.3 | 11.0 | 13.1 | 10.5 | 10.6 | 6.4 | 7.1 | 5.7 | 7.6 | 7.7 | 8.3 |
| 6° C. 4 weeks | 10.4 | 8.8 | 13.6 | 7 | 6.6 | 8.4 | 5.9 | 6.7 | 5.6 | 5.4 | 5.4 |
| 6° C. 8 weeks | 13.6 | 10.3 | 17.3 | 8 | 11.1 | 11.1 | 7.4 | 6.3 | 8 | 7 | 3.4 |
| 6° C. 12 weeks | 11.9 | 8.8 | 17.1 | 10.8 | 8.5 | 8.9 | 6.9 | 8.1 | 7.6 | 5.5 | 24.7 |
| Freeze-Thaw | 8.5 | 5.8 | 8.5 | 7.8 | 8.4 | 6.3 | 5.8 | 6.6 | 9.3 | 5.8 | 7.9 |

Compositions 13 to 23 according to the invention exhibit good high temperature and freeze/thaw stability.

Composition 13 to 15 were subjected to the solution Test as described for Examples 5 to 9.

| Sample | % Cationic remaining 0.2 μm |
|---|---|
| 13 | 95% |
| 14 | 93% |
| 15 | 95% |

EXAMPLES H–N and 24 and 25

These composition were prepared in the same way as Examples 13 to 23.

| | H | I | J | K | L | M | N | 24 | 25 |
|---|---|---|---|---|---|---|---|---|---|
| DEQA | 11.33 | 6.82 | | | | | | 9 | |
| Arosurf TA100 | | | 9 | 7.5 | | | | | |
| HT + MAPC | | | | | 16 | 11.58 | 8.8 | | 8.8 |
| Hardened tallow fatty acid | | | | | 2.7 | 1.93 | 0.2 | | 0.2 |
| IE | | 1.36 | | | | | | | |
| APG 650 (powder) | | 6.82 | | | | | 6 | | |
| Tallow 11EO | | 6.82 | 6 | | 3 | 2.5 | | | |
| Coco 15EO | | | | | | | | | 6 |
| Coco 11EO | | | | 7.5 | | | | 6 | |
| Tallow 25EO | 1 | | | | | | | | |
| Radiasurf 7248 | 2.67 | | | | | | | | |
| Perfume | 0.9 | 0.9 | 0.9 | 0.9 | | | 0.9 | | 0.9 |
| water | | | | | to 100% | | | | |

AROSURF TA100 = distearyl dimethyl ammonium chloride ex Sherex
IE = Ditallowalkyl imidozoline ester
RADIASURF 7248 = Polyglycerol monostearate ex Olefoina
APG 650 = alkyl polyglucoside ex Henkel

Solution Test and Storage Stability

The compositions were subjected to this test as described in Examples 5 to 9. 5% solutions of the samples were also subjected to Test III as described above. The results are shown below.

| Sample | % Cationic remaining 1 μm | % Cationic remaining 0.2 μm | Initial Viscosity/ mPas | Viscosity after Freeze thaw/mPas |
|---|---|---|---|---|
| H | 4 | — | 72 | gelled |
| I | | 50 | 2.3 | 45 |
| L | | 10 | 8 | 35 |
| M | | 17 | 5 | 45 |
| N | | 29 | | |
| 24 | | 95 | 2.5 | 2 |
| 25 | | 96 | | |

Viscosities of the compositions were measured using a Carri-med rheometer for viscosities below 20 mPas and a Haake rheometer for viscosities above 20 mPas. Viscosities were measured at shear rate of 110 $s^{-1}$.

| | H | I | J | K | L | M | N | 24 | 25 |
|---|---|---|---|---|---|---|---|---|---|
| Initial Viscosity/ mPas | 10 | SET | SET | SET | 72 | 86 | 93 | 6 | 5.3 |

-continued

| | H | I | J | K | L | M | N | 24 | 25 |
|---|---|---|---|---|---|---|---|---|---|
| Freeze-Thaw | SET | SET | SET | SET | SET | SET | — | 9 | 4 |
| 37° C. 4 weeks | 8.4 | SET | SET | SET | 50 | 427 | — | 9 | 75 |
| 37° C. 12 weeks | 8 | SET | SET | SET | 121 | 735 | — | 8 | — |
| 22° C. 4 weeks | 8.7 | SET | SET | SET | 110 | 87 | — | 6 | 6.2 |
| 22° C. 12 weeks | 7.5 | SET | SET | SET | 129 | 72 | — | 6 | — |
| 4° C. 4 weeks | 9.5 | SET | SET | SET | 60 | — | — | 5 | 5.4 |
| 4° C. 12 weeks | 9.0 | SET | SET | SET | 140 | — | — | 4 | — |

After 2 weeks composition N had set.

All of the comparative examples set under certain conditions illustrating poor storage stability.

EXAMPLES P and O

These compositions were prepared by co-melting the components other than urea and adding the melt to melted urea. The resultant emulsion was spray cooled to produce a free flowing powder.

| Materials | P | Q |
|---|---|---|
| *Di-(hardened tallow) dimethyl ammonium chloride | 13.5 | 18 |
| *Mono(hardened tallow) trimethylammonium chloride | 1.5 | 2 |
| Glycerol trioleate | 7.5 | 10 |
| *Coco or tallow 15EO | 7.5 | 10 |
| UREA | 70 | 60 |

The compositions were subjected to the solution test as described in Examples 5 to 9. The composition was diluted such that the sum of components marked * was 5% by weight of the solution. The results are as follows.

| Sample | % actionic 1 μm |
|---|---|
| P | 10% |
| Q | 18% |

EXAMPLES R to W

The compositions were prepared by comelting the fabric softening compound and fatty acid and then adding to hot water. The other components were then added.

| | Samples: EP 0280 550 | | | | | |
|---|---|---|---|---|---|---|
| | R | S | T | U | V | W |
| Di-hardened tallow dimethyl ammonium chloride | 4.2 | 4.2 | 4.2 | 4.2 | 4.20 | 4.2 |
| Hardened tallow fatty acid | 0.7 | 0.7 | 0.7 | 0.7 | 0.70 | 0.7 |
| Tallow 15E0 | 6 | | | | | |
| Nonidet LE 6T (ex Shell) | | 1.0 | | | | |

-continued

| | Samples: EP 0280 550 | | | | | |
|---|---|---|---|---|---|---|
| | R | S | T | U | V | W |
| oleyl 120EO (ex Hoechst) | | | | | 4.0 | 8 |
| APG 300 (ex Henkel) | | | 4.0 | 1 | | |
| Water | 95.1 | 95.1 | 95.1 | 95.1 | 95.1 | 95.1 |

The compositions were diluted to 5% by weight of fabric softener and nonionic and then filtered according to the Solubility Test in Examples 5 to 9.

Viscosities below 20 mPas were measured using a Carrimed rheometer. Viscosities above 20 mPas were measured on a Haake rheometer. Viscosities were measured at shear rate of 110 $s^{-1}$. The Freeze/thaw stability was measured.

| | % Cationic remaining 0.2 um | Initial Viscosity/mPas | F-T Viscosity/ mPas |
|---|---|---|---|
| R | 30 | 5.9 | gelled |
| S | 29 | 11.24 | separated |
| T | <10 | 3.0 | separated (47) |
| U | <10 | 12 | 60 |
| V | <10 | 4.3 | 38 |
| W | <10 | separated | separated and gelled |

EXAMPLES 26 to 29

The compositions were prepared according to either one of the standard methods for Preparation of the Examples described above.

| | 26 | 27 | 28 | 29 |
|---|---|---|---|---|
| HEQ | 8.82 | 8.7 | 8.58 | 7.71 |
| Hardened tallow fatty acid | 0.18 | 0.3 | 0.42 | 1.29 |
| Coco 15E0 | 6 | 6 | 6 | 6 |
| IPA | | | | 0.75 |
| Propylene glycol | | 0.7 | 0.7 | |
| Glycerol | | | | 0.75 |
| Water to 100% | | | | |

The compositions were subjected to the Solubility Test described in Examples 5 to 9.

| Example | % Cationic remaining 0.2 um |
|---|---|
| 26 | 100% |
| 27 | 87% |
| 28 | 90% |
| 29 | 85% |

The results illustrate that the level of fatty acid employed may be varied over a wide range and solubility be maintained.

EXAMPLES 30 to 35

Solid compositions were prepared in the same way as series C) compositions in Examples 1 to 4.

| | 30 | 31 | 32 | 33 | 34 | 35 |
|---|---|---|---|---|---|---|
| HT TMPAC | 60 | 60 | 60 | | 60 | |
| DEQA | | | | 60 | | 60 |
| Arquad 2HT (ex Axzo) | | | | | | |
| Cocolactobionamide | | 20 | 20 | 40 | | |
| Betaine | | 20 | | | 40 | 40 |
| Tego L5351 | | | | | | |
| Coco 15EO | | | 20 | | | |
| N-methyl-1-deoxyglucitylcocamide | 40 | | | | | |

*ex Th Goldschmidt

Compositions were subjected to the Solubility Test and Tests II and III as described above.

| | % Cationic remaining 1 um | % Cationic remaining 0.2 um | Initial Viscosity/ mPas | Test II Viscosity after 24 hours at 60° C./mPas | Test III Viscosity after Freeze-thaw/mPas |
|---|---|---|---|---|---|
| 30 | — | 85 | 3.7 | 2.5 | 3.8 |
| 31 | — | 89 | 4.4 | 1.9 | 1.4 |
| 32 | — | 100 | 2.9 | 4.4 | 1.9 |
| 33 | — | 77 | 2.6 | 2.1 | 2.4 |
| C | 13% | — | | | |

The comparative compositions, X and Y, were prepared by the same method.

| | | |
|---|---|---|
| X consisted of: | HT TMADC | 89 |
| | DOBANOL 91-6 | 0.7 |
| | Tallow 25EO | 3.8 |
| | PEG 1500 | 3.8 |
| | Pristerine 4916 | 6.5 |
| Y consisted of: | DEQA | 75.5 |
| | Radiosurf 7248 | 17.8 |
| | Tallow 25EO | 6.7 |

The softening performance of compositions 31, 33 and X was measured.

| | Softness score |
|---|---|
| 31 | 4.5 |
| 33 | 5.0 |
| x | 7.25 |

The compositions were subjected to the Residue Test described above. The results are as follows.

Residue Test Results

| | Frequency | Area (%) | Patch |
|---|---|---|---|
| 30 | 10/12 | 6.25 | 1 |
| 31 | 5/12 | 1.83 | 1 |
| 32 | 6/12 | 2.33 | 1 |
| 33 | 4/12 | 2.75 | 1 |
| 34 | 0/12 | 0 | 0 |
| 35 | 0/12 | 0 | 0 |
| X | 12/12 | 18.08 | 2 |
| Y | 12/12 | 23.75 | 4 |

Solid compositions according to the invention generally exhibit excellent stability and residue characteristics.

We claim:

1. A fabric softening composition comprising i) a substantially water insoluble fabric softening compound comprising a quaternary ammonium head group and two alkyl or alkenyl chains each having an average chain length equal to or greater than $C_{14}$ or a single alkyl or alkenyl chain with an average chain length equal to or greater than $C_{20}$, and ii) a solubilising agent comprising a nonionic surfactant and optionally a non-surfactant cosolubiliser, characterised in that when the fabric softening composition is diluted in water to a concentration of 5 wt % of (i)+(ii), at least 70 wt % of the fabric softening compound is in solution.

2. A fabric softening composition according to claim 1 in which the water insoluble fabric softening compound comprises a head group and two linear alkyl chains each having an average chain length equal to or greater than $C_{14}$.

3. A fabric softening composition according to claim 1, in which the solubilising agent comprises a nonionic surfactant and a non-surfactant co-solubiliser.

4. A fabric softening composition according to claim 1 in which the weight ratio of solubilising agent to fabric softening compound is greater than 1:6.

5. A fabric softening composition according to claim 4 in which the ratio of solubilising agent to fabric softening compound is within the range of from 2:3 to 4:1.

6. A fabric softening composition according to claim 1 in which the fabric softening compound has a solubility of less than $1\times10^{-3}$ wt % in demineralised water at 20° C.

7. A fabric softening composition according to claim 1 in which the fabric softening compound is a quaternary ammonium compound.

8. A fabric softening composition according to claim 7 in which the fabric softening compound is a quaternary ammonium compound having at least one ester link.

9. A fabric softening composition according to claim 8 in which the softening compound is 1,2 bis[hardened tallowoyloxy]-3-trimethylammonium propane chloride.

10. A fabric softening composition according to claim 1 in which the level of solubilising agent is greater than 10 wt % of the total composition.

11. A fabric softening composition according to claim 1 in which the composition is in the form of self-size-limiting molecular aggregates.

12. A fabric softening composition according to claim 1 which is in liquid form.

13. A fabric softening composition according to claim 12 which is translucent.

14. A fabric softening composition according to claim 1 which is in granular or powder form.

15. A fabric conditioning composition according to claim 14 in which the level of solubilising agent is greater than 20% of the total composition.

16. A composition according to claim 1 wherein the softening compound is

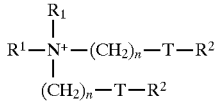

wherein each $R^1$ group is independently selected from the group consisting of $C_{1-4}$ alkyl, hydroxyalkyl and $C_{2-4}$ alkenyl groups; and where each $R^2$ group is independently selected from the group consisting of $C_{8-28}$ alkyl and alkenyl groups;

T is

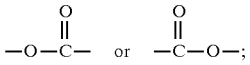

and n is an integer from 0–5.

17. A composition according to claim 1 wherein the softening compound is

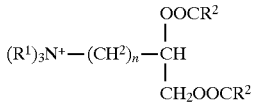

wherein $R^1$ is independently selected form the group consisting of $C_{1-4}$, alkyl, hydroxyalkyl and $C_{2-4}$ alkenyl;

$R^2$ is independently selected form the group consisting of $C_{8-28}$ alkyl and alkenyl; and n is an integer from 0–5.

18. A method of conditioning fabrics comprising the steps of:

(a) making a fabric conditioning composition comprising i) a substantially water insoluble fabric softening compound comprising a compound having two $C_{12-22}$ alkyl or alkenyl groups connected to a quaternary ammonium head group via at least one ester link or a quaternary ammonium compound having only one long chain with an average chain length equal to or greater than $C_{20}$ and, ii) a solubilizing agent comprising a noionic surfactant, characterized in that when the fabric softening composition is diluted in water to a concentration of 5 wt. % of (i) and (ii), at least 70 wt. % of the fabric softening compound is in solution;

b) forming the fabric conditioning composition into self-size-limiting molecular aggregates; and c) contacting fabrics with the molecular aggregates to soften the fabrics.

* * * * *